United States Patent [19]

Kahn

[11] Patent Number: 4,521,906

[45] Date of Patent: Jun. 4, 1985

[54] SPEAKER SYSTEMS FOR PRODUCING BALANCED STEREO IMAGES AT MULTIPLE LOCATIONS

[76] Inventor: Leonard R. Kahn, 137 E. 36 St., New York, N.Y. 10016

[21] Appl. No.: 479,223

[22] Filed: Mar. 28, 1983

[51] Int. Cl.[3] ..... H04R 5/00

[52] U.S. Cl. ..... 381/24; 381/27; 381/86

[58] Field of Search ..... 181/144, 145, 148; 381/27, 24, 25, 111, 116, 117, 86

[56] References Cited

U.S. PATENT DOCUMENTS

| | | | |
|---|---|---|---|
| 3,164,676 | 1/1965 | Brunner | 381/27 |
| 3,276,538 | 10/1966 | Guyton et al. | 181/148 X |
| 4,136,755 | 1/1979 | Goes | 181/145 X |

FOREIGN PATENT DOCUMENTS

| | | | |
|---|---|---|---|
| 2705962 | 8/1978 | Fed. Rep. of Germany | 381/24 |
| 1596851 | 9/1981 | United Kingdom | 381/24 |

*Primary Examiner*—Gene Z. Rubinson
*Assistant Examiner*—W. J. Brady
*Attorney, Agent, or Firm*—E. A. Onders; F. R. Agovino

[57] ABSTRACT

A stereo speaker system is shown having at least three individual speakers arranged along a path, with one of the speakers positioned between the other two speakers and connected to receive signals from a selected one of a pair of left and right signal outputs from a stereo signal source such as a stereo radio. Both of the other two speakers are connected to receive signals from the remaining one of said pair of outputs. Balanced stereo images are thus obtained simultaneously at two different locations. The system has particular application in an automobile. Another embodiment is shown which uses more than three speakers.

1 Claim, 2 Drawing Figures

SPEAKER SYSTEMS FOR PRODUCING BALANCED STEREO IMAGES AT MULTIPLE LOCATIONS

BACKGROUND OF THE INVENTION

This invention relates to systems of speaker arrangements for stereo or other multi-channel program material, which systems use three or more individual speakers or sound transducers.

In the conventional system of stereo speaker arrangement, two speakers (eg. a left speaker and a right speaker) are typically positioned at opposite ends of a room or the dashboard of a car. However, in car stereo speaker arrangements for example, when the stereo balance control is properly set for the driver, who is physically closer to the left speaker at the left end of the dashboard, the front seat passenger, who is physically closer to the right speaker at the right end of the dashboard, will perceive an unbalanced stereo image which is shifted too far to the left. Also, if the stereo balance control is set so that a person positioned generally equidistant between the left and right speakers perceives a stereo image having equal audio level right and left components, both the driver and the passenger of the vehicle will perceive unbalanced stereo images which are shifted too far to the right, and too far to the left, respectively. Typically, the dashboard of an automobile is about five to six feet wide, so that a balanced stereo image will be perceived only by a person sitting in the middle of the car, assuming the balance control is adjusted so that the two speakers emit substantially equal audio power. Therefore, in most such environments, only one person will be able to enjoy a balanced stereo image at any one time.

SUMMARY OF THE INVENTION

In accordance with the present invention, a stereo speaker system is provided having a plurality of individual sound speakers or transducers arranged along a path. The speakers are connected to a stereo signal source in an arrangement whereby the speakers of one set are connected to one channel of a stereo signal source, and wherein the speakers of a second set, which may only be one speaker, are connected to the other or second channel of the stereo signal source and are interleaved between the speakers of the first set. In a typical automobile application, three individual speakers or transducers may be provided, mounted along the front dashboard with two speakers of one set physically positioned at opposite ends of the dashboard, i.e. extreme left and extreme right, and connected to a first stereo signal source, (i.e. the left channel output). A centrally positioned third individual speaker is connected to a second stereo signal source (i.e. the right channel output). As a result, separate balanced stereo images can be created at different physical locations spaced from each other so that two individuals occupying those locations each can enjoy substantially balanced stereo images simultaneously.

It is, therefore, an object of the present invention to provide improved systems of stereo speaker arrangement which can simultaneously produce substantially balanced stereo images at multiple locations.

For a better understanding of the present invention, together with other and further objects, reference is made to the following description, taken in conjunction with the accompanying drawings, and its scope will be pointed out in the appended claims.

DESCRIPTION OF THE INVENTION

Figure 1:
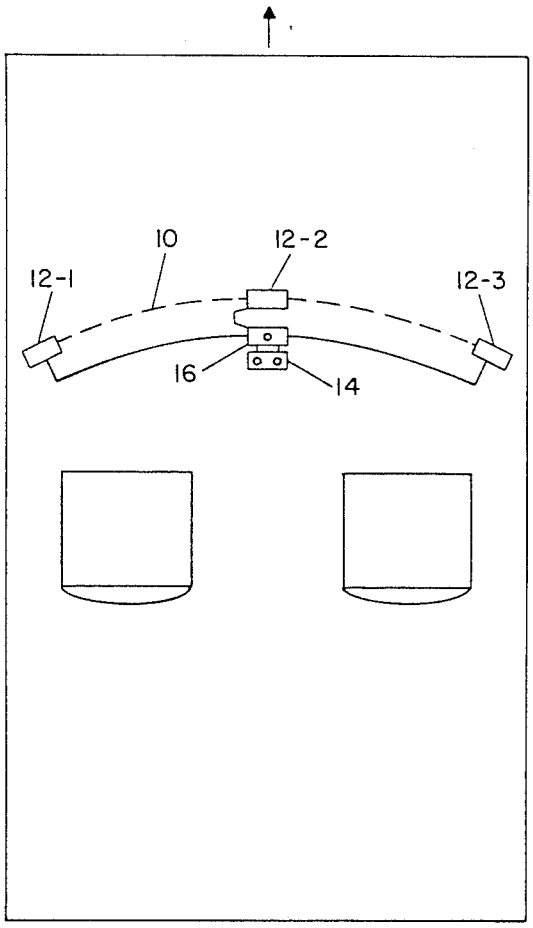
FIG. 1 is a stereo speaker arrangement according to the invention shown in the environment of an automobile.

FIG. 1 illustrates a preferred embodiment of a stereo speaker system according to the invention intended for use in an automobile or similar vehicle. The system comprises a plurality of speakers or audio transducers having generally unidirectional sound transmitting characteristics and arranged along a path 10. In this particular case, the system is shown as being used in an automobile and the speakers are mounted along the dashboard, which is generally curved. Therefore, the path along which the individual speakers are mounted is shown as being also curved. Alternatively, or in addition, the speakers may be mounted along the rear shelf of the vehicle. The individual speakers 12 are connected to form two different speaker sets, each of which receives a signal from a different channel of stereo signal source 14, such as a stereo radio or tape player.

As shown in FIG. 1, the extreme left and extreme right speakers 12-1 and 12-3 are connected to the left channel of the stereo signal source 14, and the middle speaker 12-2 is connected to the right channel of the stereo signal source 14.

In accordance with the present invention, a balance control or adjustment means may also be provided so that the total amount of audio power emitted by each speaker set can be adjusted. This balance control 16 may be arranged to adjust the relative audio power emitted by both sets of speakers with a single control knob. Alternately, there may be two separate balance controls: one for the driver and one for the passenger shown in the environment of FIG. 1. In the latter arrangement the driver's control would adjust the balance between speakers 12-1 and 12-2 by adjusting the amount of audio power from speaker 12-1, for example. Similarly, the passenger's balance control would adjust the balance between speakers 12-2 and 12-3 by adjusting the amount of audio power from speaker 12-3.

Figure 2:
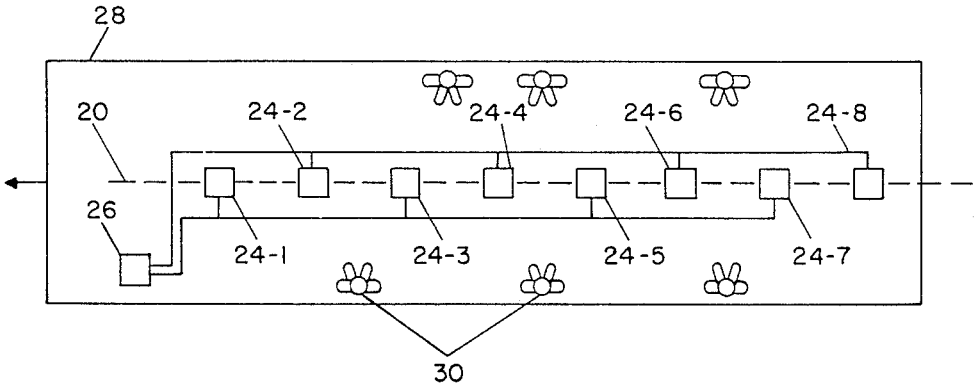
FIG. 2 is another stereo speaker arrangement according to the invention having more than three individual speakers.

In the embodiment of FIG. 2, a stereo speaker system in accordance with the invention comprises two sets of individual stereo speakers, wherein all speakers are arranged along a linear path 20 and wherein both speaker sets have a multiple number of individual speakers 24. A first set of speakers comprises individual speakers 24-1, 24-3, 24-5, and 24-7, while a second set of speakers, comprising individual speakers 24-2, 24-4, 24-6, and 24-8, is interleaved with those of the first set. The first set of speakers is shown connected to one channel of stereo signal source 26, while the second set of speakers is shown connected to the other channel of stereo signal source. The FIG. 2 arrangement can be used in a larger vehicle such as a bus 28, a plane or a train, where a large number of passengers 30 are seated at predetermined fixed locations throughout the vehicle. In the illustrated bus installation, the path 20 of speakers is located in the center of the ceiling of the vehicle, with the speakers mounted recessed into the ceiling. The speakers have unidirectional sound transmitting characteristics similar to the speakers illustrated in FIG. 1, and the speakers are oriented such that their sound is directed in a direction which is substantially orthogonal to path 20. It will be recognized that the individual speakers shown in FIG. 2 could, instead be pairs of multiple speakers, with the speakers in each such group oriented so as to create a desired sound field at each passenger location. The FIG. 2 system could also be used in a large room, such as a lecture hall, or concert hall or auditorium where people are seated in predetermined locations at which balanced stereo images are desired.

The number of speakers in a system can be any desired number, and while the distance between adjacent speakers is preferably equal, equal spacing is not essential to the invention.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A speaker system for use in a vehicle, such as an automobile, in connection with a source of stereophonic signals having a pair of separate left and right stereo audio signal outputs, comprising:

first, second and third speakers arranged along a path extending generally across the width of the passenger compartment of said automobile, wherein said first and third speakers are located at opposite ends of said path and said second speaker is located approximately midway between said first and third speakers;

and means for coupling said first and third speakers to a selected one of said pair of stereo audio signal outputs and said second speaker to the remaining one of said pair of outputs, and for providing independent adjustment of the stereo image balance between said first and second speakers and between said second and third speakers.

* * * * *